US010400475B2

(12) United States Patent
Klammer et al.

(10) Patent No.: US 10,400,475 B2
(45) Date of Patent: Sep. 3, 2019

(54) SYSTEMS AND METHODS FOR KEY RECOGNITION

(71) Applicant: Schlage Lock Company LLC, Carmel, IN (US)

(72) Inventors: Peter Klammer, Wheat Ridge, CO (US); William P. Dye, Indianapolis, IN (US); Michael P. Hogan, Carmel, IN (US); Samir Moustaffa Tamer, San Jose, CA (US); Donald D. Baker, Carmel, IN (US); Douglas A. Holmes, Golden, CO (US)

(73) Assignee: Schlage Lock Company LLC, Carmel, IN (US)

( * ) Notice: Subject to any disclaimer, the term of this patent is extended or adjusted under 35 U.S.C. 154(b) by 146 days.

(21) Appl. No.: 15/366,533

(22) Filed: Dec. 1, 2016

(65) Prior Publication Data

US 2017/0152677 A1 Jun. 1, 2017

Related U.S. Application Data

(60) Provisional application No. 62/261,475, filed on Dec. 1, 2015.

(51) Int. Cl.
*E05B 11/00* (2006.01)
*E05B 27/00* (2006.01)
(Continued)

(52) U.S. Cl.
CPC ..... *E05B 27/0042* (2013.01); *E05B 11/00* (2013.01); *E05B 19/0011* (2013.01);
(Continued)

(58) Field of Classification Search
CPC ..... E05B 47/00; E05B 49/00; E05B 49/006; E05B 47/0642; E05B 47/063; E05B 47/0044; E05B 45/06; E05B 35/001; E05B 19/0011; E05B 11/00; E05B 27/0042; E05B 47/0001; E05B 49/002; E05B 17/10
USPC ..... 70/276, 277, 278.1–278.7; 340/5.1, 5.2, 340/5.21, 5.5, 5.54, 5.6, 5.61, 5.64, 5.65, 340/5.66, 5.74, 5.8
See application file for complete search history.

(56) References Cited

U.S. PATENT DOCUMENTS 3,582,890 A * 6/1971 Rivers ..... E05B 49/006 235/458
3,688,269 A * 8/1972 Miller ..... E05B 49/006 235/382
(Continued)

*Primary Examiner* — Suzanne L Barrett
(74) *Attorney, Agent, or Firm* — Taft Stettinius & Hollister LLP

(57) ABSTRACT

A lock device including a keyway sized and configured to receive a key, a sensor assembly including an optical source and a key height sensor, and a controller in communication with the sensor assembly. The optical source is configured to generate an optical signal, and the key height sensor is configured to generate a key height signal in response to receiving the optical signal. The key is configured to interact with the optical signal such that the key height signal varies based upon the height of the key. The controller is configured to generate a key profile based at least in part upon the key height signal, to compare the key profile to authorization data, to select an action based upon the comparing, and to perform the action.

26 Claims, 12 Drawing Sheets

(51) Int. Cl.

| | |
|---|---|
| ***E05B 19/00*** | (2006.01) |
| ***E05B 45/06*** | (2006.01) |
| ***E05B 35/00*** | (2006.01) |
| ***E05B 47/00*** | (2006.01) |
| ***E05B 47/06*** | (2006.01) |
| ***E05B 49/00*** | (2006.01) |

(52) U.S. Cl.
CPC ..... *E05B 35/001* (2013.01); *E05B 45/06* (2013.01); *E05B 47/0044* (2013.01); *E05B 47/063* (2013.01); *E05B 47/0642* (2013.01); *E05B 49/006* (2013.01)

(56) References Cited

U.S. PATENT DOCUMENTS 3,700,859 A 10/1972 Laurer et al.
3,733,862 A * 5/1973 Killmeyer ..... E05B 49/006 250/215
3,790,957 A * 2/1974 Dukes ..... G06Q 20/4037 340/5.6
3,797,936 A * 3/1974 Dimitriadis ..... E05B 49/006 250/556
3,822,396 A * 7/1974 Watase ..... E05B 49/00 361/172
3,845,361 A * 10/1974 Watase ..... G07C 9/00103 340/5.66
3,845,362 A 10/1974 Roe
3,889,501 A 6/1975 Fort
3,902,342 A * 9/1975 Zucker ..... E05B 49/006 70/402
3,940,738 A * 2/1976 Teeters ..... E05B 49/006 340/543
4,090,175 A * 5/1978 Hart ..... E05B 49/006 340/5.3
4,298,792 A * 11/1981 Granholm ..... E05B 49/006 235/375
4,322,719 A * 3/1982 Moorhouse ..... E05B 49/006 235/382
4,415,893 A 11/1983 Roland et al.
4,625,100 A * 11/1986 Smith ..... G07C 1/20 235/377
4,656,851 A * 4/1987 Leek ..... E05B 45/10 340/542
4,721,956 A * 1/1988 Demster ..... E05B 49/006 340/11.1
4,868,559 A * 9/1989 Pinnow ..... E05B 49/006 340/5.67
4,870,400 A 9/1989 Downs et al.
4,982,587 A * 1/1991 Tzou ..... E05B 49/004 70/277
5,132,661 A * 7/1992 Pinnow ..... E05B 49/006 340/5.28
5,337,588 A * 8/1994 Chhatwal ..... E05B 17/22 264/264
5,543,665 A * 8/1996 Demarco ..... B60R 25/04 340/5.6
6,318,137 B1 11/2001 Chaum
7,073,708 B2 * 7/2006 Moorhouse ..... E05B 19/0035 235/130 R
8,314,681 B2 * 11/2012 Bell ..... B60R 25/00 340/5.6
8,686,869 B2 * 4/2014 Sharma ..... G01B 7/31 292/251.5
2003/0205070 A1 * 11/2003 Chaum ..... E05B 49/002 70/278.3
2004/0182923 A1 * 9/2004 Bench ..... E05B 49/006 235/382
2007/0241859 A1 * 10/2007 Bhat ..... E05B 45/06 340/5.1
2010/0077809 A1 * 4/2010 Gerner ..... E05B 39/00 70/278.2
2012/0304713 A1 12/2012 Chien et al.
2017/0298654 A1 * 10/2017 Holmes ..... E05B 27/0042

* cited by examiner

SYSTEMS AND METHODS FOR KEY RECOGNITION

CROSS-REFERENCE TO RELATED APPLICATIONS

This application claims the benefit of U.S. Provisional Application Ser. No. 62/261,475 filed Dec. 1, 2015, the contents of which are incorporated herein in their entirety.

TECHNICAL FIELD

The present disclosure generally relates to recognition of mechanical keys, and more particularly but not exclusively relates to electronic recognition of mechanical key codes.

BACKGROUND

Certain lock devices include mechanisms for electronically sensing the bitting profile of a mechanical key. Some such systems have limitations such as, for example, being susceptible to wear and/or improperly authenticating unauthorized keys. Therefore, a need remains for further improvements in this technological field.

SUMMARY

An exemplary lock device includes a keyway sized and configured to receive a key, a sensor assembly including an optical source and a key height sensor, and a controller in communication with the sensor assembly. The optical source is configured to generate an optical signal, and the key height sensor is configured to generate a key height signal in response to receiving the optical signal. The key is configured to interact with the optical signal such that the key height signal varies based on the height of the key. The controller is configured to generate a key profile based, at least in part, on the key height signal, to compare the key profile to authorization data, to select an action based upon the comparing, and to perform the action. Further embodiments, forms, features, and aspects of the present application shall become apparent from the description and figures provided herewith.

DETAILED DESCRIPTION OF ILLUSTRATIVE EMBODIMENTS

Figure 1:
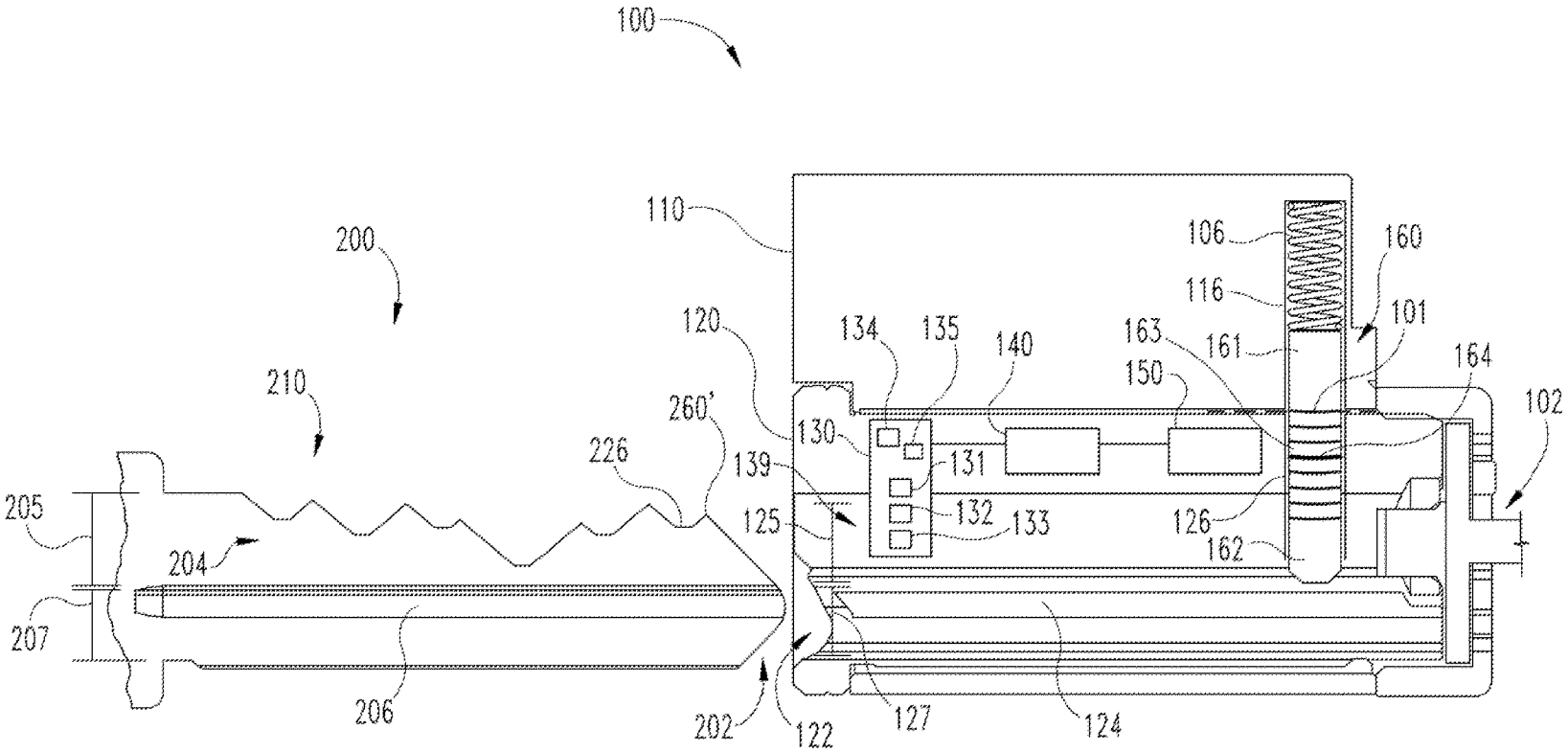
FIG. 1 is a cross-sectional illustration of a key and a lock cylinder according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 is a schematic illustration of a lock cylinder 100 according to one embodiment. The lock cylinder 100 is configured for use with a key 200, and generally includes a shell 110, a plug 120 rotatably mounted in the shell 110, a sensor assembly 130, a controller 140 in communication with the sensor assembly 130, and an actuator 150 in communication with the controller 140.

The plug 120 includes a keyway 122 sized and configured to receive the key 200, and may further include a ward 124 configured to be received in a groove 206 formed in the side surface of the key 200. The lock cylinder 100 may also include a tailpiece 102 configured for connection with a lockset such that rotation of the tailpiece 102 alters the locked/unlocked state of the lockset. The keyway 122 includes a bitting region 125 configured to receive a bitting section 205 of the key 200, and a base region 127 configured to receive a base section 207 of the key 200.

The sensor assembly 130 includes an optical source 131 operable to emit an optical signal into a sensing region 139 of the keyway 122, and at least one optical sensor 132 configured to generate an output signal in response to receiving the optical signal. The sensor assembly 130 may further include a wake-up sensor 133 configured to supply full power to the controller 140 when the key 200 is inserted, and to cause the controller 140 to enter a sleep mode when the key 200 is removed. The sensor assembly 130 also includes a key height sensor 134 operable to sense a height of the key 200 in the sensed region 139, and may further include a key length sensor 135 operable to sense the insertion length of the key 200 into the keyway 122.

As described in further detail below, the key height sensor 134 includes at least one of the optical sensors 132, and the key length sensor 135 may also include one or more of the optical sensors 132. In certain embodiments, the key length sensor 135 may comprise an array of the optical sensors 132 such as, for example, as described below with reference to the key length sensor array 540. In other embodiments, the key length sensor 135 may include a rotary quadrature encoder which includes a rotor, and which may further include one or more of the optical sensors 132. Insertion of the key 200 may rotate the rotor, thereby causing an output signal of the encoder to vary as the key 200 is inserted. In further embodiments, the key length sensor 135 may be an inductive sensor including an inductive coil that is wrapped around the keyway 122. In such embodiments, insertion of the key 200 will cause the inductance of the inductive coil to increase such that an output of the inductive sensor corresponds to the inserted length of the key 200.

Figure 2:
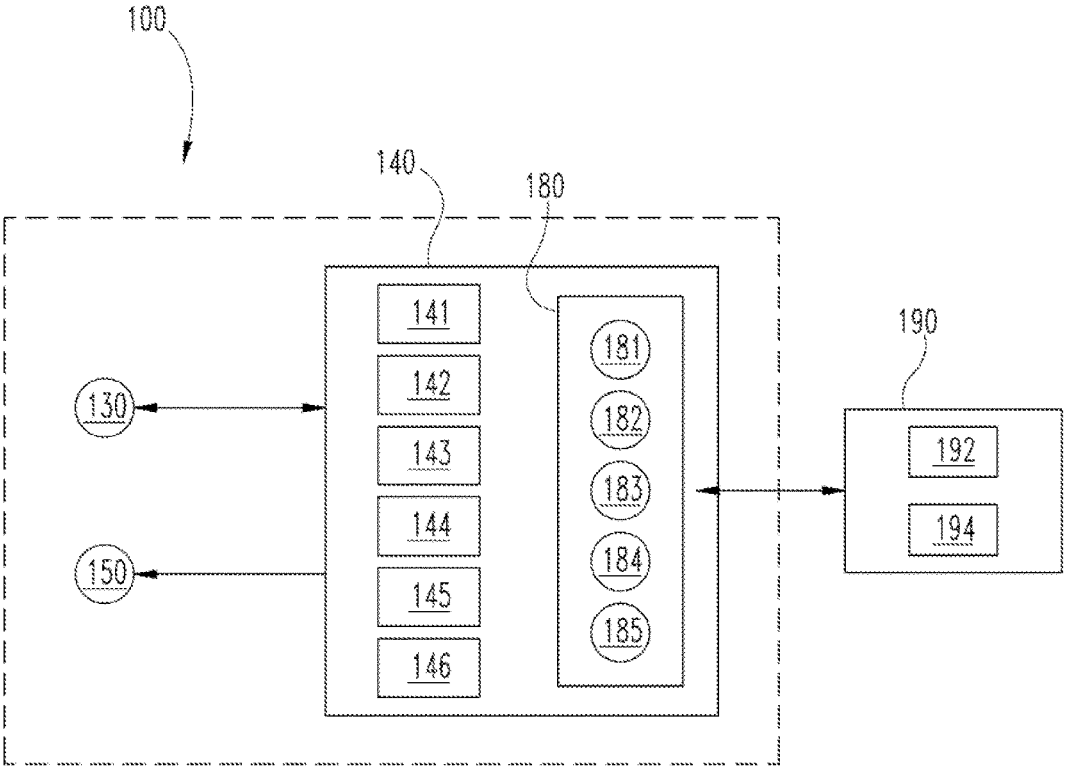
FIG. 2 is a schematic block diagram of the lock cylinder illustrated in FIG. 1.

With additional reference to FIG. 2, the controller 140 is in communication with the sensor assembly 130, and is configured to generate a key profile based upon information received from the sensor assembly 130. The controller 140 is also configured to compare the key profile to authorization data, to select an action based on the comparing, and to issue one or more commands related to the action and/or to perform the action. The actuator 150 is in communication with the controller 140, and is also configured to perform one or more of the actions in response to the commands issued by the controller 140.

With additional reference to FIG. 2, the controller 140 includes a plurality of units 141-146. For example, the controller 140 may include an optical signal generation unit 141, a sensor communication unit 142, a key profile generation unit 143, a comparing unit 144, an action selection unit 145, and an action performance unit 146, each of which may be configured to perform one or more of the operations described below with reference to FIG. 4. The controller 140 may further include a memory 180 in the form of a non-transitory computer readable medium having information or data stored thereon. For example, the memory 180 may have stored thereon sensor data 182, authorization data 183, action data 184, and/or one or more look-up tables 185. The memory 180 may also have stored thereon instructions 181 which, when executed by a processor, cause the controller 140 to perform one or more of the actions associated with the units 141-146. The controller 140 may, for example, be provided in the form of a computing device such as that described below with reference to FIG. 11.

The controller 140 is in communication with the sensor assembly 130, and may further be in communication with the actuator 150. As described in further detail below, the optical signal generation unit 141 is configured to cause the optical source 131 to generate an optical signal, the sensor communication unit 142 is configured to receive information from the sensor assembly 130, and the key profile generation unit 143 is configured to generate a key profile based upon the information received from the sensor assembly 130. Additionally, the comparing unit 144 is configured to compare the key profile with the authorization data 183, the action selection unit 145 is configured to select an action based upon the comparing, and the action performance unit 146 is configured to perform the selected action and/or issue commands related to the action. For example, the action performance unit 146 may issue to the actuator 150 a command related to the action, and the actuator 150 may perform the action in response to the command.

The controller 140 may further be in communication with an external system 190, which may include a power supply 192 configured to supply electrical power to the controller 140 and/or an access control system 194. In certain forms, the controller 140 may be operable to update the information stored on the memory 180 based upon information received from the access control system 194. The controller 140 may additionally or alternatively be configured to transmit information to the access control system 194, such as information related to the key profile or selected actions.

The actuator 150 is in communication with the controller 140, and is configured to transition between a first state and a second state in response to commands from the controller 140. In certain forms, the first state may be a retaining state, and the second state may be a release state. For example, the lock cylinder 100 may an interchangeable core lock cylinder including a control lug operable to selectively retain the cylinder 100 in a cylinder housing. In such forms, the actuator 150 may retain the lug in a core-retaining position when in the retaining state, thereby retaining the cylinder 100 in the cylinder housing. The actuator 150 may move the lug or allow the lug to be moved to a core-releasing position when in the release state, thereby allowing the cylinder 100 to be removed from the cylinder housing for repair or replacement.

In other forms, the first state may constitute a locked state, and the second state may constitute an unlocked state. In certain embodiments, the actuator 150 may be included in a clutch device operable to selectively couple the plug 120 to the tailpiece 102, for example as described below with reference to FIG. 4. In other embodiments, the actuator 150 may be configured to selectively prevent rotation of the plug 120, for example as described below with reference to FIG. 8.

Figure 3:
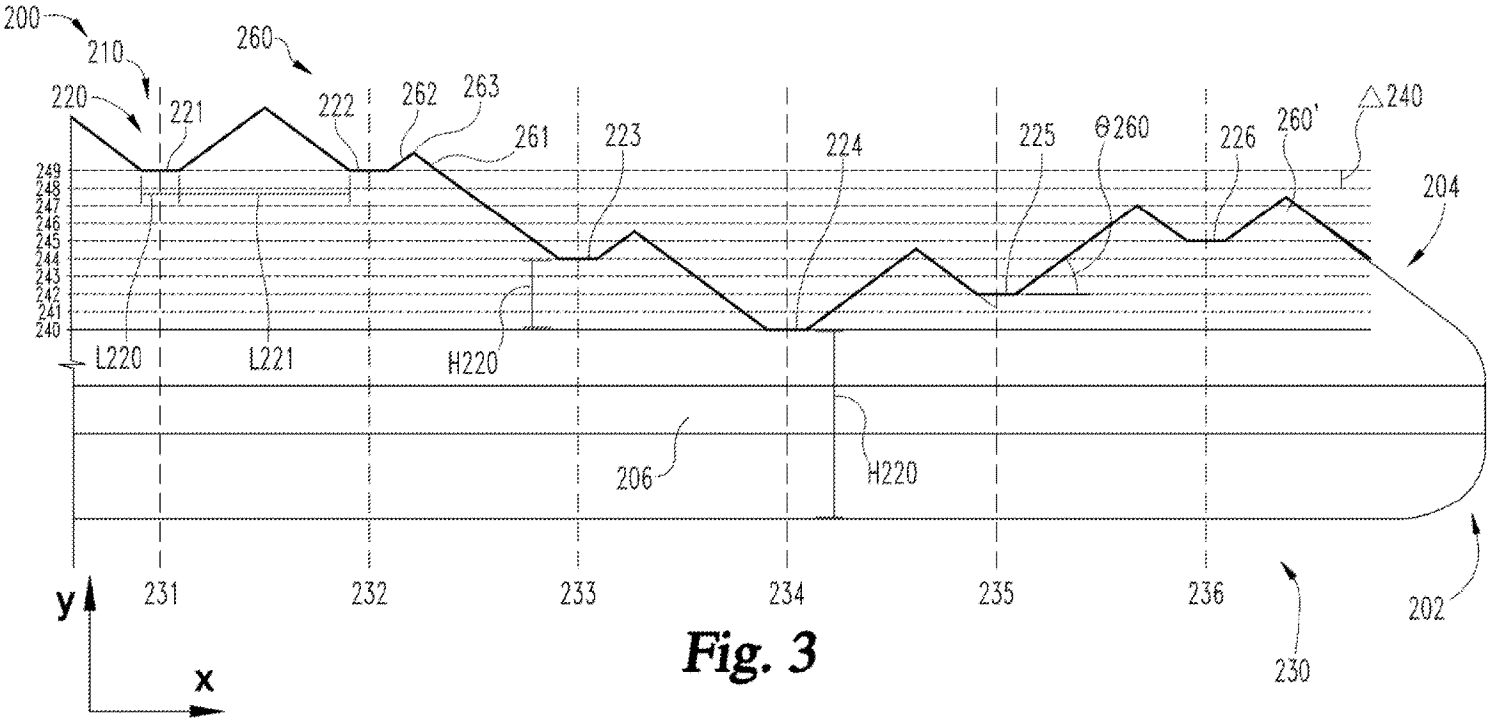
FIG. 3 is an illustration of the key depicted in FIG. 1.

With additional reference to FIG. 3, the key 200 generally includes a tip 202 and an edge cut 204 formed in a bitting section 205 of the key 200, and may further include a longitudinal groove 206 formed in a base section 207 of the key 200. When the key 200 is inserted into the plug 120, the bitting section 205 of the key 200 is received in a bitting region 125 of the keyway 122, and the base section 207 of the key 200 is received in a base region 127 of the keyway 122.

The edge cut 204 defines a bitting profile 210 of the key 200, and generally includes a plurality of bittings 220 and a plurality of teeth 260 disposed between the bittings 220. Each of the bittings 220 is formed at a bitting position 230 of the key 200, and may have a predetermined or set length L220 in the longitudinal direction X. The teeth 260 may also have a predetermined or set length L260 in the longitudinal direction X such that the bittings 220 are offset from one another by the tooth length L260.

Figure 3A:
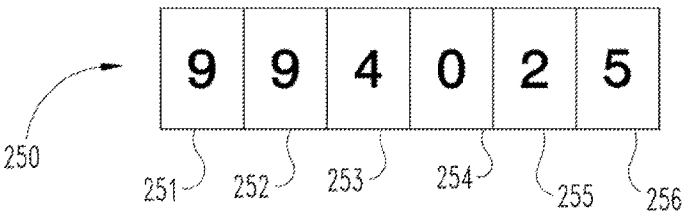
FIG. 3A is an exemplary embodiment of a bitting code.

The key 200 has a root depth H200 in a lateral or height direction Y, and the bitting profile 210 causes the root depth H200 to vary along the longitudinal or length direction of the key 200. The root depth H200 at each of the bitting positions 230 may be selected from a predetermined set of root depths, such that each of the bittings 220 has a corresponding bitting height H220. For example, the bitting heights H220 in the illustrated key 200 range from a minimum bitting height 240 to a maximum bitting height 249, with a constant increment or step Δ240 between successive heights. In such forms, the bitting profile 210 may be represented by a bitting code 250 (FIG. 3A) having a plurality of digits 251-256, wherein each of the digits 251-256 corresponds to one of the bitting positions 231-236, and has a value representative of the bitting height H220 at the corresponding bitting position 231-236. For example, the value "9" of the first digit 251 indicates that the key 200 has the maximum bitting height 249 at the first bitting position 231, and the value "0" of the fourth digit 254 indicates that the key 200 has the minimum bitting height 240 at the fourth bitting position 234. Thus, the bitting code 250 corresponding to the illustrated bitting profile 210 is "994025".

Each tooth 260 has a first or distal ramp 261, a second or proximal ramp 262, and a peak 263 connecting the ramps 261, 262. Each of the ramps 261, 262 may define a predetermined ramp angle θ260 with respect to the longitudinal or X direction. As the key 200 is inserted into the keyway 122, the root depth H200 within the sensing region 139 increases as the distal ramp 261 passes through the sensing region 139, and decreases as the proximal ramp 262 passes through the sensing region 139. As such, the distal ramp 261 may be considered to constitute an upward slope and the proximal ramp 262 may be considered to constitute a downward slope as the key 200 is inserted into the keyway 122. Conversely, the distal ramp 261 may be considered to constitute a downward slope, and the proximal ramp 262 may be considered to constitute an upward slope as the key 200 is subsequently withdrawn from the keyway 122.

The lock cylinder 100 may further include a tumbler set 160 operable to retain the key 200 in the keyway when the plug 120 is in a rotated position. For example, the tumbler set 160 may extend between a pair of tumbler shafts 116, 126 formed in the shell 110 and the plug 120. A spring 106 may be positioned in the shell tumbler shaft 116 to urge the tumbler set 160 toward the keyway 122. In the illustrated form, the tumbler set 160 is a pin tumbler set including a top or driving pin 161 seated in the shell tumbler shaft 116, a bottom or driven pin 162 seated in the plug tumbler shaft 126, and a plurality of intermediate pins 163 positioned between the driving pin 161 and the driven pin 162. The tumbler set 160 also has a plurality of break points 164, each of which is defined at an interface between two of the pins 161-163.

The driven pin 162 extends into the keyway 122, and engages the foremost bitting 226 when the key 200 is fully inserted into the plug 120. When the driven pin 162 is engaged with the bitting 226, one of the break points 164 is aligned with a shear line 101 defined between the shell 110 and the plug 120. As such, the driving pin 161 is contained within the shell 110, the driven pin 162 is contained within the plug 120, and each of the intermediate pins 163 is contained within either the shell 110 or the plug 120. When the plug 200 is rotated, the driven pin 162 and potentially one or more of the intermediate pins 163 are captured between the bitting 226 and the inner surface of the shell 110.

If the user attempts to remove the key 200 while the plug 120 is in the rotated position, the proximal ramp 262 of the foremost tooth 260' engages the driven pin 162, thereby urging the driven pin 162 radially outward. This urging causes the driven pin 162 or one of the intermediate pins 163 to engage the inner surface of the shell 110, thereby preventing movement of the driven pin 162. The driven pin 162 is thus captured within the bitting 226 and prevents removal of the key 200. When the plug 120 is subsequently returned to the home position, the captured pins 162, 163 become free to travel into the shell tumbler shaft 116, thereby permitting removal of the key 200.

In certain forms, the tumbler set 160 may serve only to prevent removal of the key 200 when the plug 120 is in the rotated position. For example, the height of the driven pin 162 may be such that the break point 164 between the driven pin 162 and the lowermost intermediate pin 163 is aligned with the shear line 101 when the foremost bitting 226 has the maximum bitting height 249, and each of the intermediate pins 163 may have a height substantially equal to the bitting step Δ240. In other words, the height of the intermediate pins 163 is equal to the bitting step Δ240 within manufacturing tolerances. As a result, each bitting height 240-249 will cause one of the break points 164 to align with the shear line 101.

In other forms, the tumbler set 160 may provide a mechanical locking function as a supplement to the electronic locking function. For example, the tumbler set 160 may be configured such that a first subset of the bitting heights 240-249 will cause one of the break points 164 to align with the shear line 101, and a second subset of the bitting heights 240-249 will cause one of the pins 161-163 to cross the shear line 101. In certain forms, the intermediate pins 163 may be omitted, such that the tumbler set 160 has a single break point 164. In such embodiments, the tumbler set 160 may prevent rotation of the plug 120 when the foremost bitting 226 does not have the correct bitting height to align the break point 164 with the shear line 101.

Figure 4:
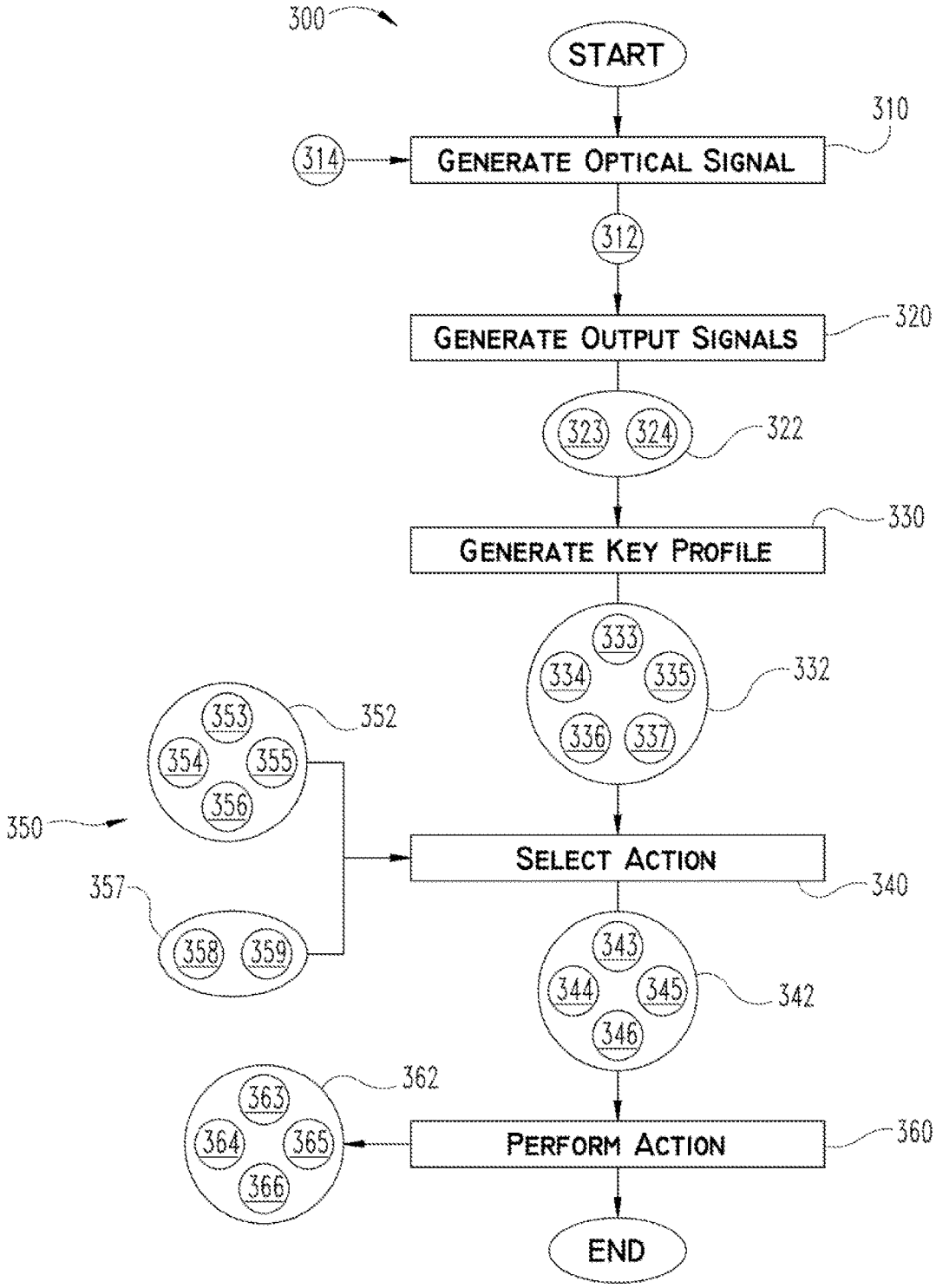
FIG. 4 is a schematic flow chart illustrating a process which may be performed using the lock cylinder illustrated in FIG. 1.

With additional reference to FIG. 4, illustrated therein is an exemplary process 300 which may be performed using one or more of the lock cylinders described herein. Operations illustrated for the processes in the present application are understood to be examples only, and operations may be combined or divided, and added or removed, as well as re-ordered in whole or in part, unless explicitly stated to the contrary. Unless specified to the contrary, it is contemplated that certain operations or steps performed in the process 300 may be performed wholly by the sensor assembly 130, controller 140, actuator 150, and/or external system 190, or that the operations or steps may be distributed among one or more of the elements and/or additional devices or systems which are not specifically illustrated in the Figures.

The process 300 begins with an operation 310 which includes generating an optical signal 312 such as, for example, by activating the optical source 131. In certain embodiments, the operation 310 may be performed in response to an actuating event 314 such as, for example, by actuation of the wake-up sensor 133. The operation 310 may, for example, include issuing an activation signal with the optical signal generation unit 141, and generating the optical signal 312 with the optical source 131 in response to the activation signal.

The process 300 also includes an operation 320 which includes generating one or more output signals 322. The operation 320 may, for example, include receiving the optical signal 312 with one or more of the optical sensors 132, and generating the output signals 322 in response thereto. The operation 320 may also include generating a key height signal 323 and/or a key length signal 324 based upon the output signals 322 of the optical sensors 132. The operation 320 may further include storing information related to the output signals 322 such as, for example, in the memory 180. The operation 320 may, for example, be performed by the sensor assembly 130 and the sensor communication unit 142.

The process 300 also includes an operation 330 which includes generating a key profile 332 based at least in part upon the key height signal 323. Generation of the key profile 332 may further be based in part upon the key length signal 324. The key profile 332 includes information relating to the bitting profile 210, such as bitting code information 333 relating to the bitting code 250, slope information 334 relating to the ramp angles θ260 of the teeth 260, bitting length information 335 relating to the lengths L220 of the bittings 220, and/or tooth length information 336 relating to the lengths L260 of the teeth 260. As described in further detail below, the operation 330 may also include generating a key insertion speed profile 337 based upon the key height signal 323 and/or the key length signal 324, and calculating one or more of the slope information 334, bitting length information 335, and tooth length information 336 based upon the insertion speed profile 337 and the key height signal 323. The operation 330 may, for example, be performed by the sensor assembly 130 and key profile generation unit 143.

In certain embodiments, the operations 310, 320 may be performed in series with the operation 330. For example, the operations 310, 320 may be iteratively, continually, or continuously performed as the key 200 is inserted, and information related to the output signals 322 may be stored in the memory 180 for subsequent use in the operation 330 after the key 200 is fully inserted. In other embodiments, the operations 310, 320, 330 may be performed in parallel with one another as the key 200 is being inserted. For example, the operation 330 may include iteratively building the key profile 332 based on current values of the output signals 322, and storing the key profile 332 in the memory 180.

After the key profile 332 is generated, the process 300 may continue to an operation 340, which includes selecting an action 342 based upon the key profile 332. The operation 340 may include comparing the key profile 332 to authorization data 350 using the comparing unit 144, and selecting the action 342 using the action selection unit 145. As described in further detail below, the selected action 342 may include one or more of an unlock action 343, an alarm action 344, a rekey action 345, and a cylinder removal action 346.

The authorization data 350 may include one or more authorized key profiles 352 including information relating to an authorized bitting profile 210. For example, each authorized key profile 352 may include bitting code information 353, slope information 354, bitting length information 355, and/or tooth length information 356. The authorization data 350 may further include additional information 357 associated with one or more of the authorized key profiles 352. The additional information 357 associated with an authorized key profile 352 may include action information 358 and/or scheduling information 359. For example, when the generated key profile 332 matches an authorized key profile 352, the action 342 may be selected based upon the action information 358 associated with the matching authorized key profile 352. The scheduling information 359 may indicate that an associated profile 352 is authorized only during certain times or for a certain number of uses.

The process 300 further includes an operation 360, which includes performing the selected action 342 such as, for example, by issuing a command associated with the selected action 342. For example, when the selected action 342 includes the unlock action 343, the operation 360 may include causing the controller 140 to issue an unlock command to the actuator 150 and/or causing the actuator 150 to set the cylinder 100 in the unlocked state. When the selected action 342 includes the rekey action 344, the operation 360 may include storing information relating to the key profile 332 of the next key 200 inserted into the cylinder 100, and adding or removing the new key profile 332 as an authorized key profile 352. When the selected action 342 includes the alarm action 345, the operation 360 may include causing the controller 140 to issue an alarm signal such as, for example, to the access control system 194.

Figure 5:
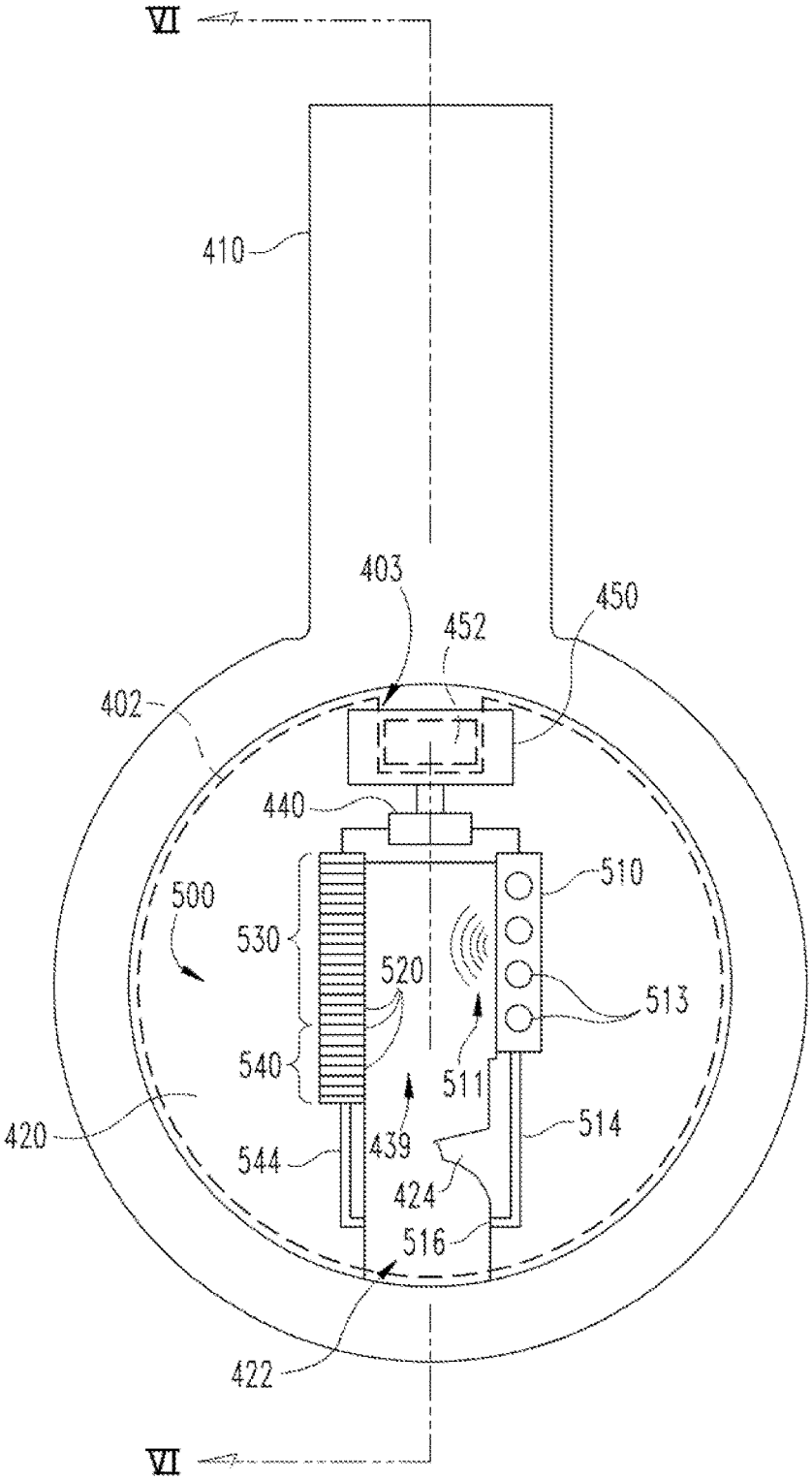
FIG. 5 is a cross-sectional illustration of a lock cylinder according to another embodiment.
Figure 6:
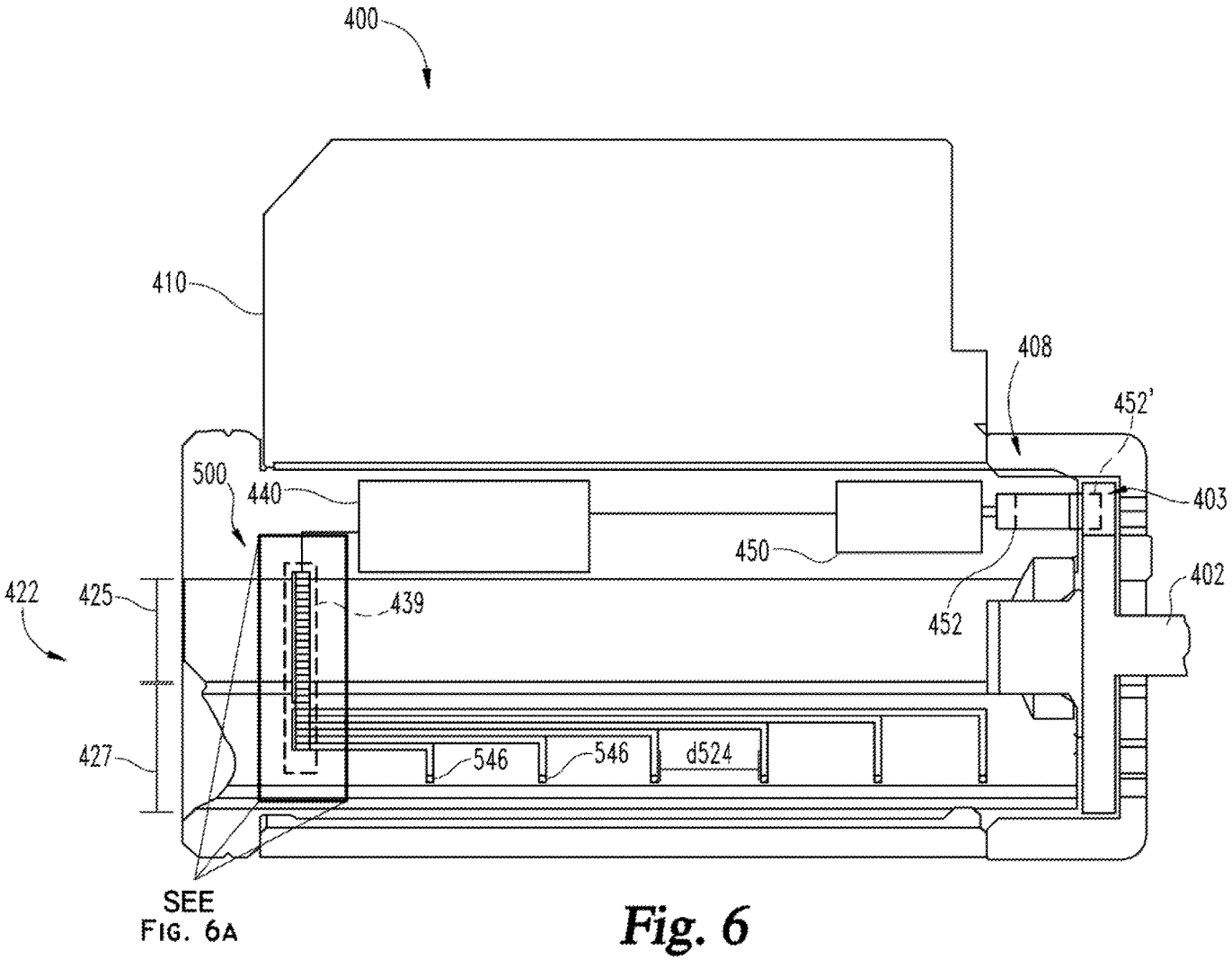
FIG. 6 is a cross-sectional view taken along the cut line VI-VI in FIG. 5.
Figure 6A:
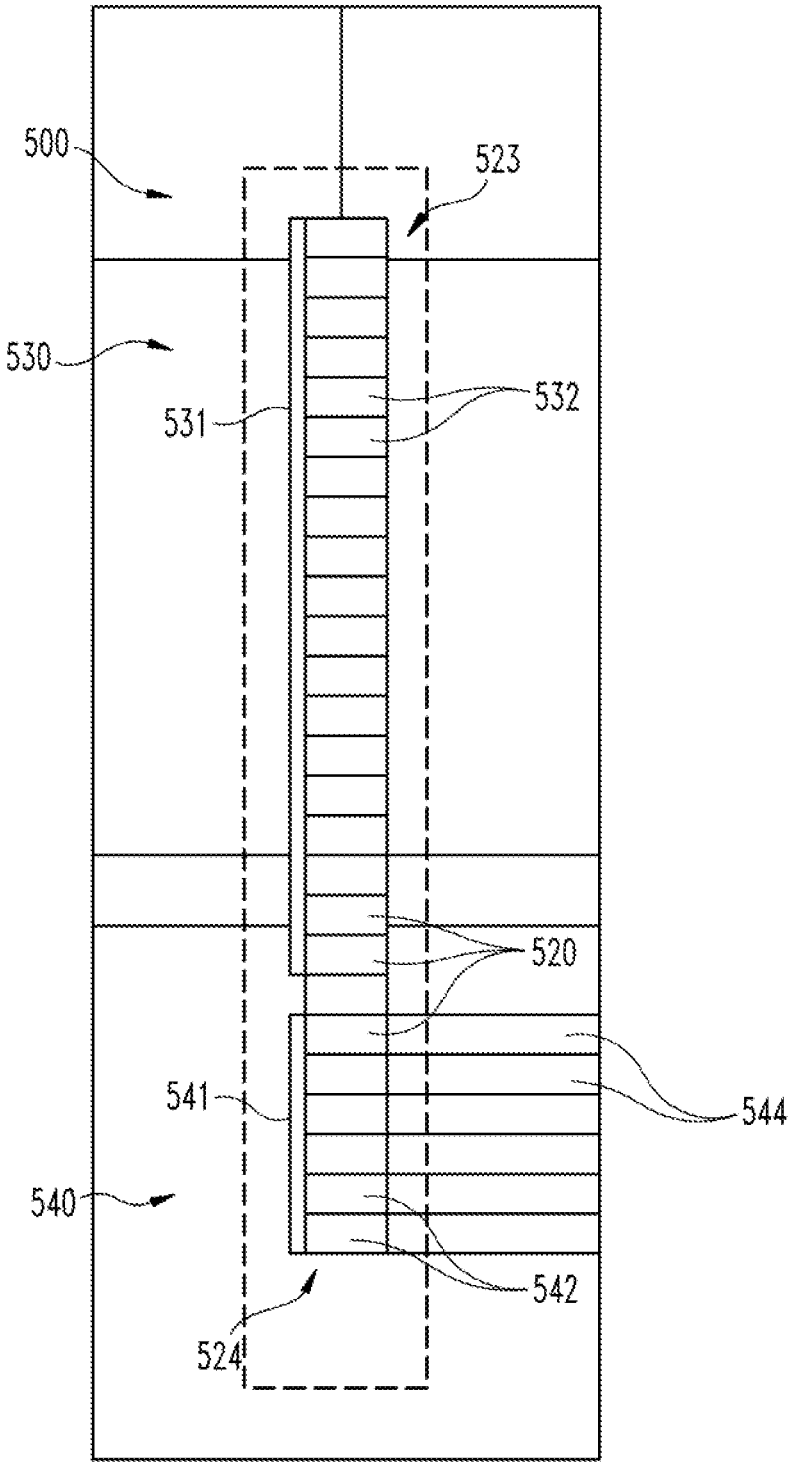
FIG. 6A is an enlarged view of a portion of FIG. 6

FIGS. 5, 6 and 6A illustrate a lock cylinder 400 according to one embodiment. The lock cylinder 400 may, for example, constitute an implementation of the lock cylinder 100 illustrated in FIG. 1. Unless indicated otherwise, similar reference characters are used to indicate similar elements and features. For example, the lock cylinder 400 includes a shell 410, a plug 420 rotatably mounted in the shell 410, a controller 440, and an actuator 450 in communication with the controller 440. The lock cylinder 400 also includes a sensor assembly 500 which may correspond to the sensor assembly 130 described above. In the interest of conciseness, the following descriptions focus primarily on elements and features of the lock cylinder 400 which are not described above with reference to the lock cylinder 100.

In the illustrated form, the lock cylinder 400 includes a clutch mechanism 408 including the actuator 450 and the tailpiece 402. The actuator 450 includes an armature 452, and the tailpiece 402 includes an opening 403 sized and shaped to receive the armature 452. The clutch mechanism 408 is operable to selectively transmit rotation of the plug 420 to the tailpiece 402. More specifically, the clutch mechanism 408 has an unclutched or locked state, and a clutched or unlocked state. In the locked or clutched state, the armature 452 is in a retracted position, and is not received within the opening 403. As a result, the plug 420 is rotationally decoupled from the tailpiece 402, and is therefore not operable to rotate the tailpiece 402. In the unlocked or clutched state, the armature 452 is in an extended position 452', and extends into the opening 403. As a result, the plug 420 is rotationally coupled to the tailpiece 402, and is therefore operable to rotate the tailpiece 402.

The sensor assembly 500 generally includes an optical source 510, a plurality of optical sensors 520, and a key height sensor 530 including a height sensor array 531, and may further include a key length sensor 540 including a length sensor array 541. The height sensor array 531 includes a first subset 523 of the optical sensors 520, and the length sensor array 541 may include a second subset 524 of the optical sensors 520. The height sensor array 531 may alternatively be referred to hereinafter as a height array 531, and the length sensor array 541 may alternatively be referred to hereinafter as a length array 541. Additionally, the optical sensors 520 of the height array 531 may be referred to as height sensors 532, and the optical sensors 520 of the length array 541 may be referred to as length sensors 542.

The optical source 510 is positioned in the plug 420 on a first side of the keyway 422, and is configured to transmit an optical signal 511 toward a second side of the keyway 422. The optical source 510 is configured to generate the optical signal 511 at a frequency detectable by the optical sensors 520 and may, for example, include one or more light emitting diodes (LEDs) 513.

The optical sensors 520 are configured to detect the optical signal 511, and to generate an output signal in response to receiving the optical signal 511. In certain forms, the output signal may be a digital signal which is generated when the strength of the optical signal 511 received by the optical sensor 520 exceeds a threshold value. In other forms, the output signal may be an analog signal which varies in response to the strength of the received optical signal 511. In the illustrated embodiment, the optical sensors 520 are positioned on a second side of the keyway 422 opposite the optical source 510. In other embodiments, at least some of the optical sensors 520 may be positioned on the first side of the keyway 422, and the second side of the keyway may include a reflecting surface configured to reflect the optical signal 511 toward the optical sensors 520.

In the illustrated form, the key height sensor 530 is located near the entrance of the keyway 422, and is aligned with the LEDs 513 of the optical source 510. As described in further detail below, the key height sensor 530 is configured generate a key height signal based upon the outputs of the height sensors 532. The height array 531 extends in the height direction Y along the bitting region 425 of the keyway 422. The height array 531 may include a sufficient number, density, and positioning of optical sensors 520 to cover the range of possible root depths H200 for the key 200, and to resolve the minimum difference Δ240 between distinct bitting heights H220. For example, the height array 531 may include 128 of the optical sensors 520 with a spacing of 0.0025 inches (i.e., 400 dots per inch), such that the array extends 0.32 inches in the height direction.

The key length sensor 540 extends in the length direction X along the base region 427 of the keyway 422. The key length sensor 540 includes a first plurality of light pipes 544, each of which includes a receiving end 546. The optical source 510 includes a second plurality of light pipes 514, each of which includes an emitting end 516. Each of the light pipes 514 is configured to transmit the optical signal 511 from the LEDs 513, and to emit the optical signal 511 from the emitting end 516. The emitting ends 516 are aligned with the receiving ends 546 such that the receiving ends 546 are operable to receive the optical signal 511 from the corresponding emitting end 516. Each of the light pipes 544 is connected to one of the length sensors 542, and is configured to transmit the optical signal 511 from the receiving end 546 to the connected length sensor 542. Thus, while the optical sensors 520 of the length array 541 are illustrated as being positioned near the proximal end of the keyway 422, the utilization of the light pipes 544 causes the key length sensor 540 and the length array 541 to effectively extend in the longitudinal direction of the keyway 422.

In certain forms, the sensor assembly 500 may include more or fewer light pipes, which may be in similar or alternative configurations. For example, the optical sensors 520 and/or LEDs 513 may be positioned above the keyway 422, and light pipes may direct the optical signal from the LEDs 513 to the keyway 422 and/or from the keyway 422 to the optical sensors 520. In other forms, the light pipes may be omitted. For example, the optical sensors 520 of the length array 541 may be spaced along the longitudinal direction, and the optical source 510 may include a plurality of LEDs 513 aligned therewith.

Figure 7A:
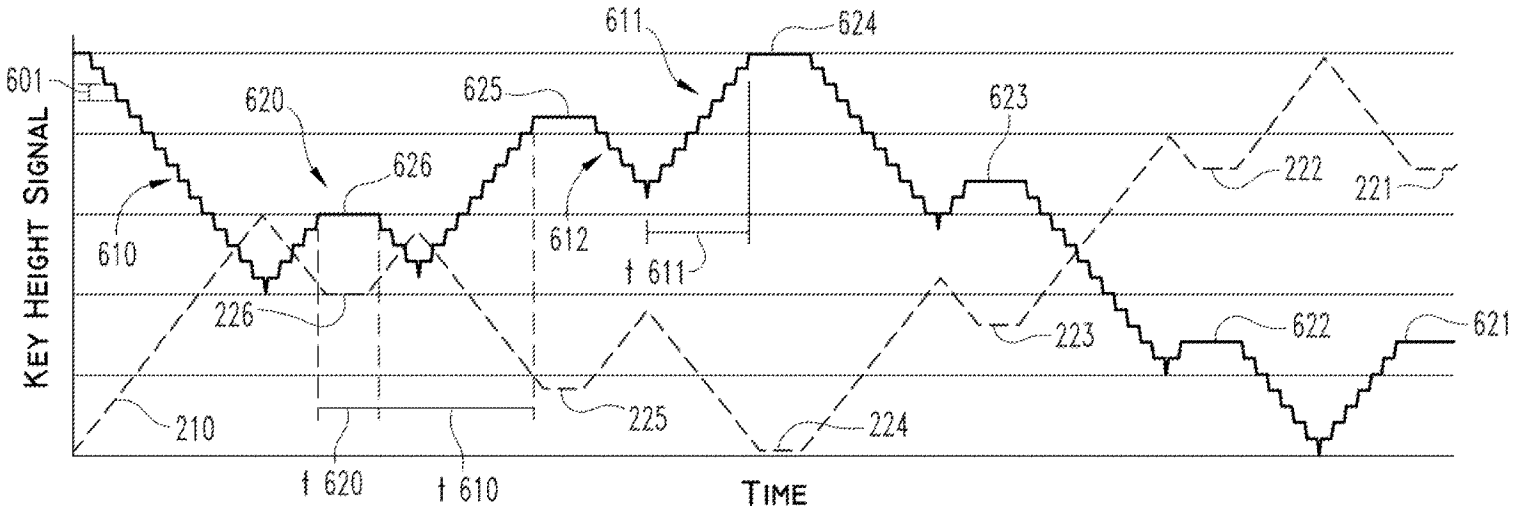
FIGS. 7A and 7B are graphs of output signals generated by a sensor assembly of the lock cylinder illustrated in FIG. 5 during a key insertion event.
Figure 7B:
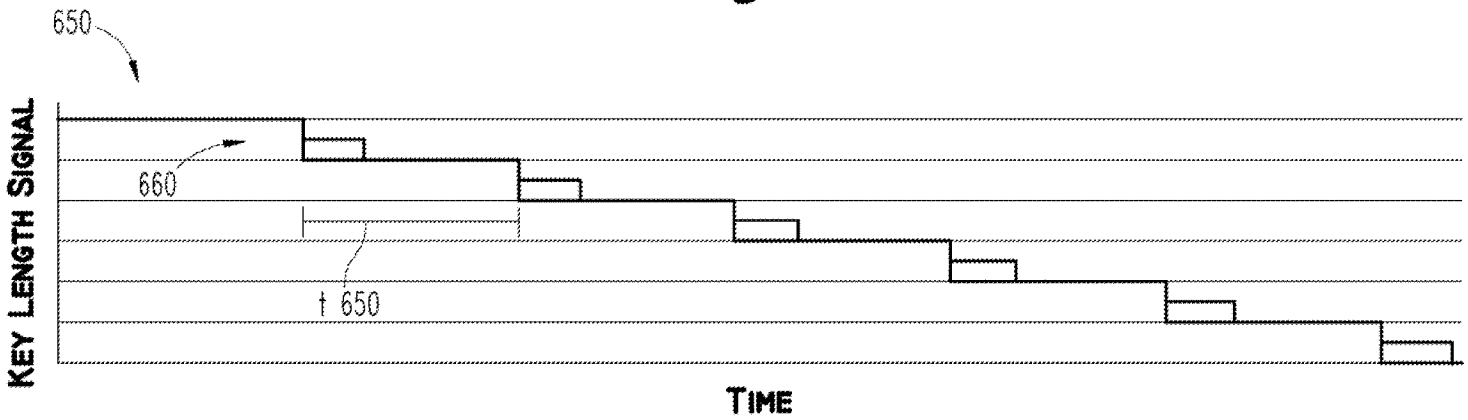

With additional reference to FIGS. 7A and 7B, each of the optical sensors 520 is configured to generate an output signal 601 in response to receiving the optical signal 511. Additionally, the key height sensor 530 is configured to generate a key height signal 600 based upon the output signals 601 of the height sensors 532, and the key length sensor 540 is configured to generate a key length signal 650 based upon the output signals 601 of the length sensors 542. In the illustrated form, the key height sensor 530 and key length sensor 540 each combine the output signals 601 of the corresponding optical sensors 520 into a single signal. More specifically, the key height sensor 530 combines the output signals 601 of the height sensors 532 into a single key height signal 600, and the key length sensor 540 combines the output signals 601 of the length sensors 542 into a single key length signal 650. In other forms, the key height signal 600 may be transmitted to the controller 440 as the individual output signals 601 of each of the height sensors 532, and/or the key length signal 650 may be transmitted to the controller 440 as the individual output signals 601 of each of the length sensors 542.

During operation, the optical source 510 transmits the optical signal 511 across the keyway 422 toward the plurality of optical sensors 520. When the key 200 is not inserted, each of the optical sensors 520 receives the optical signal 511, and generates the output signal 601 in response thereto. As the key 200 is inserted into the keyway 422, transmission of the optical signal 511 across the keyway 422 is at least partially interrupted as the key 200 passes between the optical source 510 and the optical sensors 520. More specifically, the bitting section 205 of the key 200 interrupts transmission of the optical signal 511 to the height array 531, thereby causing the key height signal 600 to exhibit valley regions 610 and plateaus 620 corresponding to the teeth 260 and bittings 220 of the bitting profile 210. Additionally, the base section 207 of the key interrupts transmission of the optical signal 511 to the length array 541, thereby causing the key length signal 650 to exhibit steps 660.

FIGS. 7A and 7B illustrate the key height signal 600 and the key length signal 650 versus time as the key 200 during an exemplary insertion event. FIG. 7A also illustrates the bitting profile 210, and more specifically illustrates the root depth H200 of the key 200 within the sensing region 439 during the insertion event. Due to the fact that the bitting profile 210 passes through sensing region 439 from tip to bow, the bitting profile 210 illustrated in FIG. 7A is flipped horizontally with respect to the illustration of FIG. 3.

As noted above, each of the optical sensors 520 is configured to generate an output signal 601 in response to receiving the optical signal 511, thereby contributing an output signal 601 unit value to the corresponding one of the height signal 600 and length signal 650. Thus, each value of the key height signal 600 is indicative of a corresponding root depth H200 within the sensing region 439, and each value of the key length signal 650 is indicative of an inserted length of the key 200. Information relating the signals 600, 650 to corresponding values of the root depth H200 and inserted key length may, for example, be stored in a look-up table, such as a look-up table 185 on the memory 180.

When no key is inserted in the keyway 422, each of the sensors 520 receives the optical signal 511 and generates the output signal 601 in response thereto. Thus, the height signal 600 and the length signal 650 are each at a maximum value prior to insertion of the key 200. As the key 200 is inserted, the distal slope 261 of the distal-most tooth 260' begins to overlap the lowermost height sensors 532, thereby preventing the lowermost height sensors 532 from receiving the optical signal 511. As such, the lowermost height sensors 532 no longer generate an output signal 601, and the height signal 600 begins to decrease, thereby causing a downward sloping region 612 corresponding to the upward sloping distal ramp 261.

As the distal-most tooth 260' passes through the sensing region 439, the height signal 600 reaches a local minimum 610' corresponding to a peak 263. The height signal 600 subsequently begins to increase as the downward sloping proximal ramp 262 passes through the sensing region 439, thereby causing an upward sloping region 611 in the height signal 600. As each bitting 220 passes through the sensing range 439, the height signal 600 remains constant at a plateau 620. Thus, the bitting height H220 of each of the bittings 220 can be determined based upon the value of the height signal 600 at a corresponding one of the plateaus 620.

As noted above, during insertion of the key 200, the key height signal 600 varies in response to the root depth H200 of the key 200 within the sensing region 439. As a result, the key height signal 600 includes a plurality of valley regions 610 corresponding to the teeth 260, and each of the valley regions 610 includes an upward sloping region 611 corresponding to one of the downward slopes 261 and a downward sloping region 612 corresponding to one of the upward slopes 262. The key height signal 600 also includes a plurality of plateaus 620 corresponding to the bittings 220. The bitting code 250 can therefore be determined based upon the values of the key height signal 600 at the plateaus 620.

In certain embodiments, a plateau 620 may be determined when the key height signal 600 remains substantially constant for a predetermined time period. In other embodiments, a plateau 620 may be determined based upon the key length signal 650. For example, the length sensors 542 may be positioned such that the key 200 begins to overlap one of the length sensors 542 when a corresponding one of the bittings 220 enters the sensing region 439. In such embodiments, a decrease in the key length signal 650 may indicate the beginning of a plateau 620. Additionally or alternatively, the length sensors 542 may be positioned such that the key 200 begins to overlap one of the length sensors 542 when a corresponding one of the bittings 220 exits the sensing region 439. In such embodiments, a decrease in the key length signal 650 may indicate the end of a plateau 620.

During the insertion event illustrated in FIGS. 7A and 7B, the key 200 is inserted at a constant or uniform insertion speed. As a result, each of the valley regions 610 span a constant valley time t610, and each of the plateaus 620 span a constant plateau time t620. It is also possible that the insertion speed may not necessarily be uniform during an insertion event. In order to account for potential non-uniform insertion speeds, an insertion speed profile may be calculated, and the key profile may be generated based in part upon the insertion speed profile. Further details regarding these operations are provided below.

With reference to FIGS. 3-7, further details will now be provided regarding the process 300 as performed with the lock cylinder 400. The operation 310 may include activating the one or more LEDs 513, thereby transmitting the optical signal 511, 312 across the width of the keyway 422. The operation 320 may include receiving the optical signal 511, 312 with the height sensor array 531, generating the output signals 601 with the height sensors 532, and generating the key height signal 600, 323 with the key height sensor 530. In embodiments which include the key length sensor 540, the operation 320 may further include receiving the optical signal 511, 312 with the length sensor array 541, generating the output signals 601 with the length sensors 542, and generating the key length signal 650, 324 with the key length sensor 540.

The operation 330 includes generating the key profile 332 based at least in part upon the key height signal 600, 323. For example, the operation 330 may include generating the bitting code information 333 based upon the plateaus 620 of the key height signal 600. The operation 330 may further include calculating a key insertion speed profile 337 based upon the key height signal 600 and/or key length signal 650, and generating information regarding a characteristic of the bitting profile 210 based upon the insertion speed profile 337. For example, one or more of the slope information 334, bitting length information 335, and tooth length information 336 may be calculated based in part upon the insertion speed profile 337.

In certain embodiments, the insertion speed profile 337 may be calculated based upon the key length signal 650, for example by dividing a known distance d542 between two adjacent length sensors 542 by a time period t650 over which the signal 650 remains constant. Additionally or alternatively, the insertion speed profile 337 may be calculated based upon the key height signal 600 and authorized values of a selected characteristic, such as the bitting length L220, the tooth length L260, and/or the ramp angle θ260.

In certain embodiments, portions of the insertion speed profile 337 may be calculated based upon an authorized length using the equation $$v = \frac{L}{\Delta t},$$

where v is the insertion speed, L is an authorized value of the bitting length L220 or tooth length L260, and Δt is the corresponding one of a plateau time t620 or valley region time t610. Additionally or alternatively, a portion of the insertion speed profile 337 may be calculated based upon an authorized value of the ramp angle θ260. For example, the value of the insertion speed profile 337 may be calculated from the equation $$v = \frac{\Delta H}{\Delta t \cdot \tan(\theta)},$$

where v is the Key insertion speed, ΔH is the change in root depth H200 indicated by one of the sloping regions 611, 612, Δt is the time period associated with the sloping region 611, 612, and θ is the authorized or known value of the ramp angle θ260. In certain embodiments, gaps in the insertion speed profile 337 may be filled in, for example by interpolating calculated values of the insertion speed profile 337.

Once generated, the insertion speed profile 337 may be used to calculate information relating to a selected characteristic of the bitting profile 210, such as the slope information 334, bitting length information 335, and/or tooth length information 336. For example, when the selected characteristic is the ramp angle θ260, the slope information 334 for a given ramp 261, 262 may be calculated using the equation $$\theta = \arctan\left(\frac{\Delta H}{\Delta t \cdot v}\right),$$

where ΔH represents the change in the root depth H200 indicated by a height of a corresponding a sloping region 611, 612 Δt is the time t611, t612 associated with the sloping region 611, 612 and v is the value or average value of the insertion speed profile 337 in the sloping region 611, 612.

When the selected characteristic is one of the bitting length L220 and the tooth length L260, the bitting length information 335 and/or tooth length information 336 may be calculated using the equation L=v·Δt. For example, if L is a value of the bitting length information 335 corresponding to the length L220 of a given bitting 220, Δt may be the time period t620 associated with the corresponding plateau region 620, and v may be the average insertion speeds across the sloping regions 611, 612 surrounding the plateau region 620. Alternatively, if L is a value of the tooth length information 336 corresponding to the length L260 of a given tooth 260, v may be the average insertion speed across the corresponding valley region 610, and Δt may be the time t610 associated with the valley region 610.

In light of the foregoing, the operation 330 may include calculating the insertion speed profile 337 based upon known or authorized values associated with a first characteristic of the bitting profile 210, and generating the key profile 332 with predicted or calculated values associated with a second characteristic of the bitting profile 210. Each of the first and second characteristics may be one of the bitting length L220, tooth length L260, and the ramp angle θ260. For example, when the insertion speed profile 337 is calculated based upon the authorized values of the bitting lengths L220, the key profile 332 may be generated to include information relating to predicted or calculated values of the tooth lengths L260 and/or the ramp angles θ260. As a second example, when the insertion speed profile 337 is calculated based upon an authorized value of the ramp angle θ260, the key profile 332 may be generated to include information relating to predicted or calculated values of the bitting lengths L220 and/or tooth lengths L260.

Alternatively, the insertion speed profile 337 may be calculated based upon the key length signal 650 as described above. In such embodiments, the key profile 332 may be generated to include information relating to predicted or calculated values of one or more characteristics of the bitting profile 210, such as the bitting lengths L220, tooth lengths L260, and/or ramp angle θ260. For example, the insertion speed profile 337 may be calculated based upon the key length signal 324, and one or more of the slope information 334, bitting length information 335, and tooth length information 336 may be calculated based on the insertion speed profile 337.

As noted above, the operation 340 includes comparing the key profile 332 to authorization information 350. Thus, when the key profile 332 includes calculated values of the slope information 334, bitting length information 335, and/or tooth length information 336, the operation 340 may include comparing the calculated values 334-336 to authorized values 354-356 of the ramp angle θ260, bitting length L220, and tooth length L260.

In embodiments in which the selected action 342 includes the rekey action 345, the rekey action 345 may include generating additional authorization data 350 based upon the next key 200 to be inserted into the keyway 422. In such forms, generating the additional authorization data may include generating an insertion speed profile 337 as the new key is inserted, and calculating additional authorized slope information 354, additional authorized bitting length information 355, and/or additional authorized tooth length information 356 based upon the new insertion speed profile 337.

Figure 8:
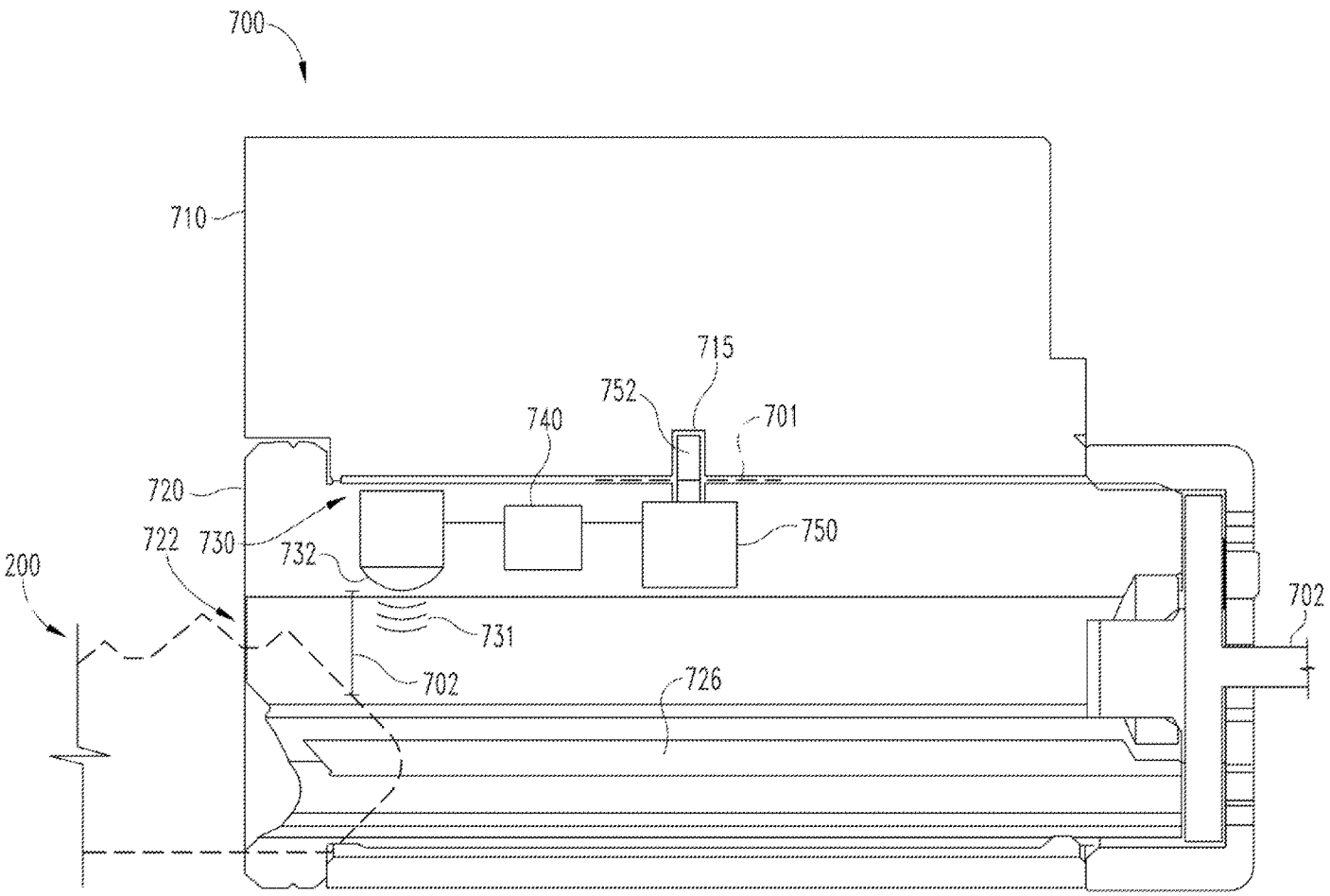
FIG. 8 is a cross-sectional illustration of a lock cylinder according to another embodiment.

FIG. 8 illustrates a lock cylinder 700 according to another embodiment. The lock cylinder 700 may, for example, be an implementation of the lock cylinder 100 illustrated in FIG. 1. Unless indicated otherwise, similar reference characters are used to indicate similar elements and features. For example, the lock cylinder 700 includes a shell 710, a plug 720 rotatably mounted in the shell 710, a sensor assembly 730, a controller 740 in communication with the sensor assembly 730, and an actuator 750 in communication with the controller 740.

The sensor assembly 730 of the instant embodiment includes a photodiode 732 positioned near the entrance of the keyway 722. The photodiode 732 is configured to emit an optical signal 733 into the keyway 722 along the height direction. When the key 200 is inserted into the keyway 722, the optical signal 733 is reflected off of the edge cut 204 toward the photodiode 732, and the photodiode 732 generates an output signal in response to receiving the reflected optical signal 733. As will be appreciated by those having skill in the art, the output signal of the photodiode 732 corresponds to the distance 702 between the photodiode 732 and the edge cut 204 of the key 200, and the distance 702 decreases as the root depth H200 of the key 200 increases.

In the illustrated form, the actuator 750 includes an armature 752, and the shell 710 includes an opening 715 sized and shaped to receive the armature 752. The actuator 750 is configured to selectively prevent rotation of the plug 720 with respect to the shell 710. More specifically, the actuator 750 has a locked state and an unlocked state. In the locked state, the armature 752 extends across the shear line 701 and is received within the opening 715. As a result, the plug 720 is rotationally coupled to the shell 710, and is therefore not operable to rotate the tailpiece 702. In the unlocked, the armature 752 is in a retracted position, and does not cross the shear line 701. As a result, the plug 720 is rotationally decoupled from the shell 710, and is therefore operable to rotate the tailpiece 702.

Figure 9B:
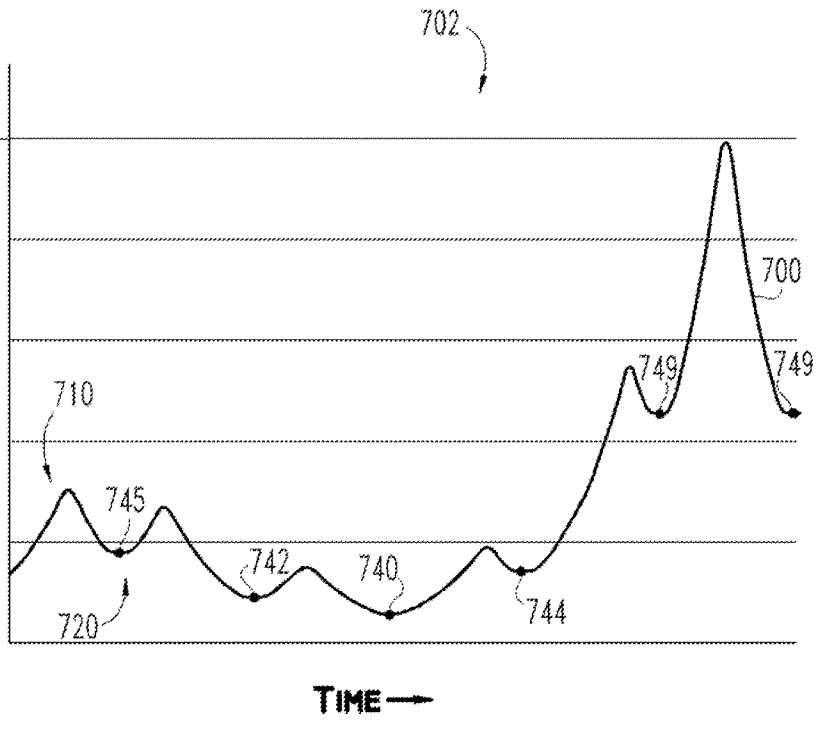
FIG. 9B is a graph of an output signal generated by a sensor assembly of the lock cylinder illustrated in FIG. 8 during a key insertion event.
Figure 9A:
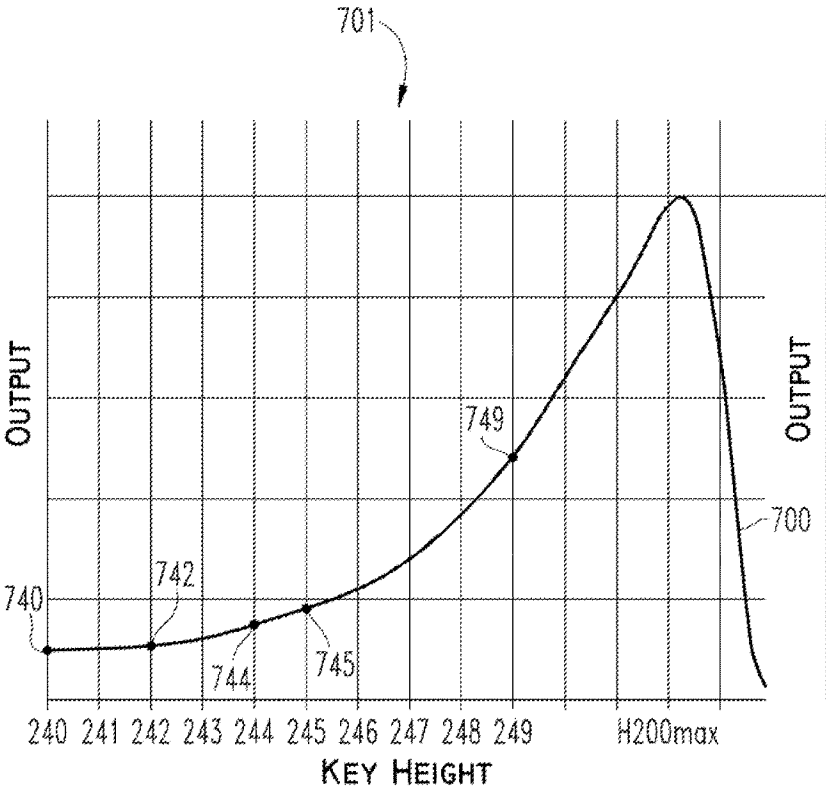
FIG. 9A is a graph of an output signal generated by a sensor assembly of the lock cylinder illustrated in FIG. 8 versus key height.

With additional reference to FIG. 9A, illustrated therein is a graph 801 of an output signal 800 of the photodiode 732 versus the root depth H200 of an inserted key 200. More specifically, the graph 801 relates each value of the output signal 800 to a corresponding root depth H200. For example, the value 840 corresponds to the minimum bitting height 240, and the value 849 corresponds to the maximum bitting height 249. The graph 801 can thus be utilized to calculate or determine the root depth H200 based upon the value of the output signal 800, for example by comparing the output signal 800 to a look-up table 185 including information representative of the graph 801.

With additional reference to FIG. 9B, illustrated therein is a graph 802 of the output signal 800 versus time during insertion of the illustrated key 200. The graph 802 has a plurality of peak regions 810 corresponding to the teeth 260, and a plurality of troughs 820 corresponding to the bittings 220. During operation, the controller 740 may determine the root depth H200 of the key 200 based upon the output signal 800 and information relating to the graph 801. For example, the first trough 820 in the graph 802 has a value 845, which corresponds to the bitting height 245 in the graph 801. Thus, the first bitting 220 to enter the keyway 722 (i.e., the distal-most bitting 226) has the bitting height 245, corresponding to the code digit 5. The subsequent troughs 820 have the values 842, 840, 844, 849, and 849. The key 200 therefore has the bitting heights 245, 242, 240, 244, 249, and 249, when read from tip to bow, corresponding to bitting code values of 5, 2, 0, 4, 9, and 9. Reversing the order of the digits to be read from bow to tip, the bitting code 250 may therefore be determined to be "994025".

The controller 740 is configured to generate a key profile based upon the output signal 800. The key profile may include the bitting code 250, and may further include additional information, such as information related to the bitting lengths L220, tooth lengths L260, and/or ramps 261, 262. For example, the controller 740 may create a graph, chart, or table including information regarding the peak regions 810, and calculate the slopes θ260 of the ramps 261, 262 accordingly.

Further details will now be provided regarding the process 300 as performed with the lock cylinder 700. The operation 310 may include activating the photodiode 732, thereby transmitting the optical signal 733, 312 in the height direction of the keyway 722 such that the optical signal 733, 312 is reflected off of the edge cut 204. The operation 320 includes receiving the reflected optical signal 733, 312 with the photodiode 732, and generating the output signal 800, 322 in response thereto. The operation 320 may further include generating the key height signal 323 based upon the output signal 800, for example by comparing the output signal 800 to a look-up table including information related to the graph 801.

The operation 330 includes generating the key profile 332 based upon the key height signal 323. For example, the operation 330 may include calculating the bitting code information 333 based upon the values of the key height signal 323 corresponding to the troughs 820 of the output signal 800. The operation 330 may further include calculating an insertion speed profile 337 based upon one characteristic of the key height signal 323 and calculating the information 334, 335, 336 associated with another characteristic in a manner analogous to that described above. For example, the operation 330 may include calculating the insertion speed profile 337 based upon an authorized value of the tooth length L260 by the time t710 associated with the peak regions 810, and calculating the bitting length information 335 based upon the insertion speed profile 337 and the time t820 associated with the trough regions 820.

Figure 10:
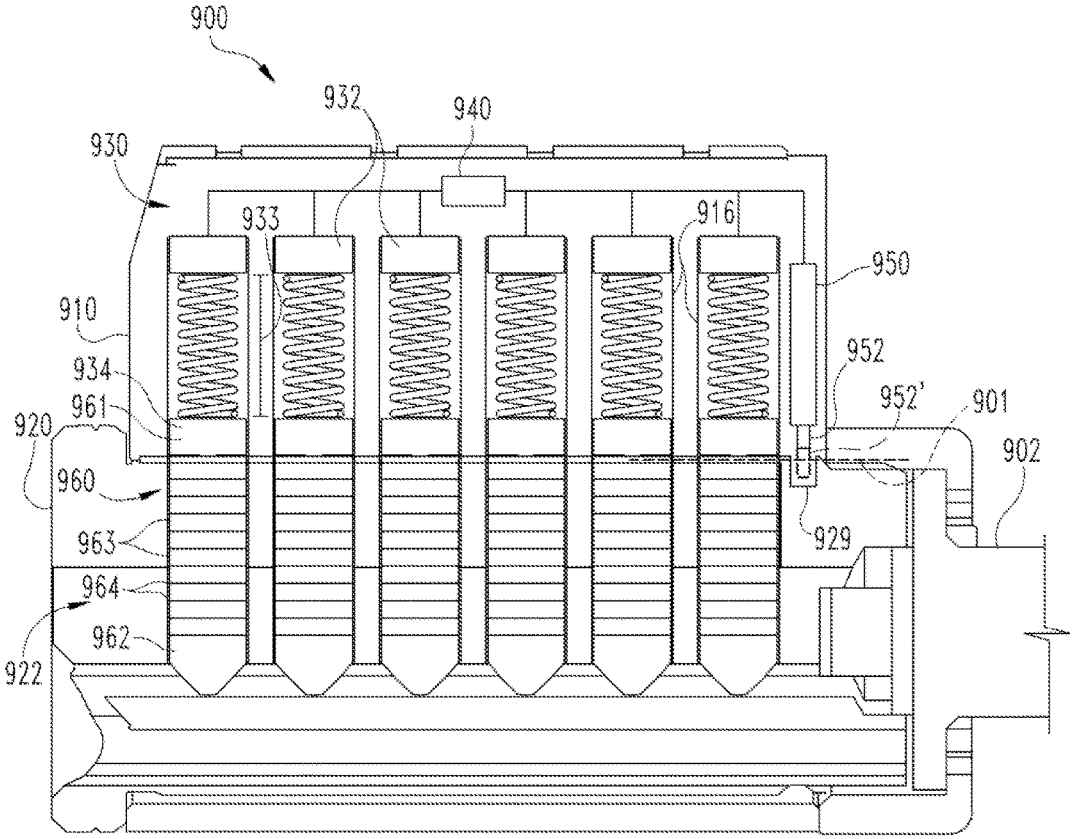
FIG. 10 is a cross-sectional illustration of a lock cylinder according to another embodiment.

FIG. 10 illustrates a lock cylinder 900 according to another embodiment. The cylinder 900 is substantially similar to the lock cylinder 100 illustrated in FIG. 1. Unless indicated otherwise, similar reference characters are used to indicate similar elements and features. For example, the lock cylinder 900 includes a shell 910, a plug 920 rotatably mounted in the shell 910, a sensor assembly 930, a controller 940 in communication with the sensor assembly 930, an actuator 950 in communication with the controller 940, and a plurality of tumbler sets 960.

The sensor assembly 930 of the current embodiment includes a plurality of Hall-effect sensors 932, each of which is seated in one of the shell tumbler shafts 916. Additionally, each of the driving pins 961 includes a magnet 934. For example, the driving pins 961 may be formed of the magnet 934, or may have the magnet 934 mounted thereon. The magnets 934 are configured to generate a signal in the form of a magnetic field, and the Hall-effect sensors 932 are configured to receive the magnetic signal and to generate an output signal in response to receiving the magnetic signal. More specifically, the output signal corresponds to the strength of the magnetic field, and is therefore indicative of the distance 933 between the sensor 932 and the corresponding magnet 934. Thus, when the key 200 is inserted, the output of each sensor 932 corresponds to the bitting height H220 of the key 200 at the corresponding bitting position 230.

The controller 940 is in communication with the sensor assembly 930, and is configured to generate a key profile based on the outputs of the sensors 932. In the illustrated form, the sensor assembly 930 includes a plurality of the Hall-effect sensors 932, and the controller is configured to generate the key profile based upon the outputs of the sensors 932 when the key 200 is fully inserted. In other embodiments, the sensor assembly 930 may include fewer Hall-effect sensors 932, and the controller 940 may generate the key profile as the key 200 is being inserted. For example, the sensor assembly 930 may include a single sensor 932, and the key profile may be generated based upon the output of the single sensor in a manner similar to that described above with reference to the lock cylinders 400, 700.

The actuator 950 is in communication with the controller 940, and is configured to perform one or more actions in response to commands from the controller 940. In the illustrated form, the actuator 950 includes an armature 952 aligned with an opening 929 formed in the plug 920, and is configured to move between a locked state and an unlocked state in response to the commands. In the locked state, the armature 952 extends into the opening 929, thereby crossing the shear line 901 and preventing rotation of the plug 920. In the unlocked state, the armature 952 is retracted, such that rotation of the plug 920 is not prevented. In other forms, the actuator may be configured to perform additional or alternative functions, such as those described above with reference to the actuator 150.

Figure 11:
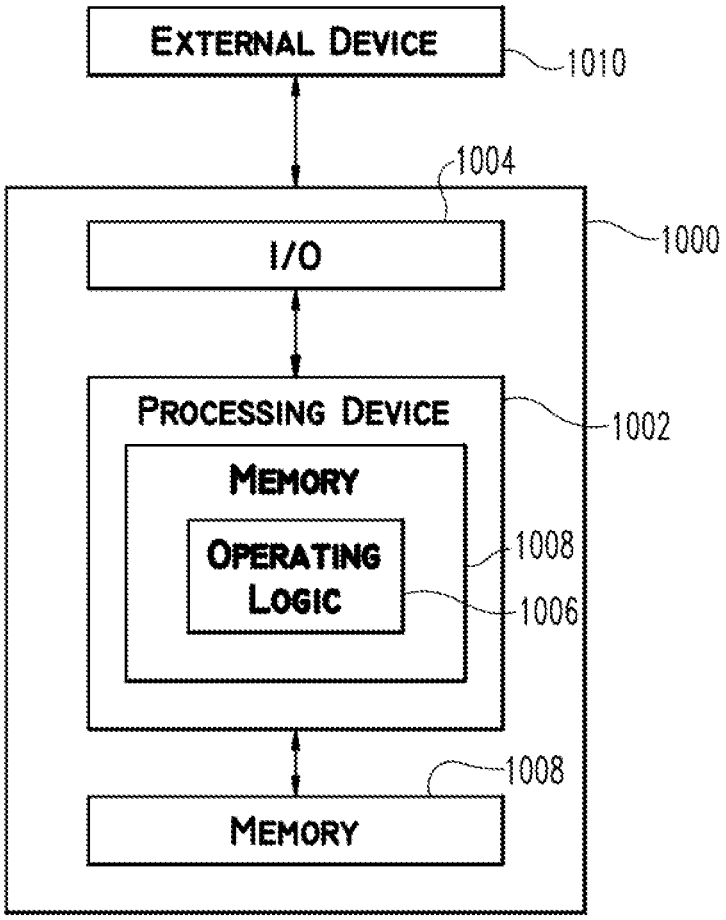
FIG. 11 is a schematic block diagram of a computing device which may be utilized in connection with certain embodiments.

FIG. 11 is a schematic block diagram of a computing device 1000, which is one example of a computer, server, or equipment configuration which may be utilized in connection with the above-described controllers. The computing device 1000 includes a processing device 1002, an input/output device 1004, memory 1006, and operating logic 1008. Furthermore, the computing device 1000 communicates with one or more external devices 1010.

The input/output device 1004 allows the computing device 1000 to communicate with the external device 1010. For example, the input/output device 1004 may be a network adapter, network card, interface, or a port (e.g., a USB port, serial port, parallel port, an analog port, a digital port, VGA, DVI, HDMI, FireWire, CAT 5, or any other type of port or interface). The input/output device 1004 may be comprised of hardware, software, and/or firmware. It is contemplated that the input/output device 1004 includes more than one of these adapters, cards, or ports.

The external device 1010 may be any type of device that allows data to be inputted or outputted from the computing device 1000. For example, the external device 1010 may be a mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 1010 may be integrated into the computing device 1000. It is further contemplated that there may be more than one external device in communication with the computing device 1000.

The processing device 1002 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of processing device 1002 with multiple processing units, distributed, pipelined, and/or parallel processing can be utilized as appropriate. The processing device 1002 may be dedicated to performance of just the operations described herein or may be utilized in one or more additional applications. In the depicted form, the processing device 1002 is of a programmable variety that executes algorithms and processes data in accordance with operating logic 1008 as defined by programming instructions (such as software or firmware) stored in memory 1006. Alternatively or additionally, the operating logic 1008 for processing device 1002 is at least partially defined by hardwired logic or other hardware. The processing device 1002 can be comprised of one or more components of any type suitable to process the signals received from input/output device 1004 or elsewhere, and provide desired output signals. Such components may include digital circuitry, analog circuitry, or a combination of both.

The memory 1006 may be of one or more types, such as a solid-state variety, electromagnetic variety, optical variety, or a combination of these forms. Furthermore, the memory 1006 can be volatile, nonvolatile, or a combination of these types, and some or all of memory 1006 can be of a portable variety, such as a disk, tape, memory stick, cartridge, or the like. In addition, the memory 1006 can store data that is manipulated by the operating logic 1008 of the processing device 1002, such as data representative of signals received from and/or sent to the input/output device 1004 in addition to or in lieu of storing programming instructions defining the operating logic 1008, just to name one example. As shown in FIG. 10, the memory 1006 may be included with the processing device 1002 and/or coupled to the processing device 1002.

The processes in the present application may be implemented in the operating logic 1008 as operations by software, hardware, artificial intelligence, fuzzy logic, or any combination thereof, or at least partially performed by a user or operator. In certain embodiments, units represent software elements as a computer program encoded on a computer readable medium, wherein the processing device 1002 causes the controller to perform the described operations when executing the computer program.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock device, comprising:

a body including a keyway sized and configured to receive a key including an edge cut defining a bitting profile of the key;

a sensor assembly, including:

a plurality of optical sensors including a plurality of first optical sensors;

a key height sensor including the plurality of first optical sensors, wherein the key height sensor extends in a height direction of the keyway; and an optical source operable to transmit an optical signal toward the plurality of optical sensors;

wherein each of the optical sensors is configured to generate an output signal in response to receiving the optical signal, and wherein the key height sensor is configured to generate a key height signal based upon the outputs of the plurality of first optical sensors such that the key height signal varies as a function of a sensed height as the key moves within the keyway; and wherein the key is configured to overlap a portion of the key height sensor as the key is inserted into the keyway, thereby preventing at least some of the first optical sensors from receiving the optical signal and causing a variation in the key height signal; and a controller in communication with the sensor assembly, wherein the controller is configured to receive the key height signal, to generate a key profile based at least in part upon the key height signal, to compare the key profile to authorization data, to select an action based upon the comparing, and to perform the action;

wherein the sensor assembly is further configured to sense an inserted length of the key within the keyway, and to generate a key length signal indicative of the inserted length such that the key length signal varies as a function of the inserted length as the key moves within the keyway, and wherein the controller is further configured to receive the key length signal and to generate the key profile based upon the key height signal and the key length signal.

2. The lock device of claim 1, wherein the sensor assembly further includes an inductive sensor including an inductive coil having a characteristic which varies based upon the inserted length, and wherein the inductive sensor is configured to generate the key length signal based upon the characteristic of the inductive coil.

3. The lock device of claim 1, wherein the controller is further configured to generate a key insertion speed profile based upon the key length signal, and to generate the key profile based upon the key height signal and the key insertion speed profile.

4. The lock device of claim 1, wherein the sensor assembly is further configured to vary the key length signal among a minimum value, a maximum value, and a plurality of intermediate values as the key moves within the keyway.

5. A lock device, comprising:

a body including a keyway sized and configured to receive a key including an edge cut defining a bitting profile of the key;

a sensor assembly, including:

a plurality of optical sensors including a plurality of first optical sensors;

a key height sensor including the plurality of first optical sensors, wherein the key height sensor extends in a height direction of the keyway; and an optical source operable to transmit an optical signal toward the plurality of optical sensors;

wherein each of the optical sensors is configured to generate an output signal in response to receiving the optical signal, and wherein the key height sensor is configured to generate a key height signal based upon the outputs of the plurality of first optical sensors; and wherein the key is configured to overlap a portion of the key height sensor as the key is inserted into the keyway, thereby preventing at least some of the first optical sensors from receiving the optical signal and causing a variation in the key height signal; and a controller in communication with the sensor assembly, wherein the controller is configured to receive the key height signal, to generate a key profile based at least in part upon the key height signal, to compare the key profile to authorization data, to select an action based upon the comparing, and to perform the action;

wherein the sensor assembly is further configured to sense an inserted length of the key within the keyway, and to generate a key length signal indicative of the inserted length, and wherein the controller is further configured to receive the key length signal and to generate the key profile based upon the key height signal and the key length signal; and wherein the plurality of optical sensors includes a plurality of second optical sensors, wherein the sensor assembly further includes a key length sensor, wherein the key length sensor extends in a length direction of the keyway and includes the second plurality of optical sensors, and wherein the key length sensor is configured to generate the key length signal based upon the output signals of the second optical sensors.

6. The lock device of claim 5, wherein the key length sensor further comprises a plurality of light pipes extending in the length direction.

7. A method of operating a lock device including a keyway sized and configured to receive a key having a bitting profile defining a bitting code, the method comprising:

transmitting an optical signal from an optical source toward a plurality of optical sensors, wherein insertion of the key into the keyway prevents at least some of the optical sensors from receiving the optical signal, wherein each of the optical sensors is configured to generate an output signal in response to receiving the optical signal, wherein a first subset of the optical sensors extends in a height direction of the keyway, and wherein a first sensing region is defined in the keyway between the optical source and the first subset of optical sensors;

generating a key height signal based upon the output signals of the first subset of optical sensors, wherein the key height signal corresponds to a height of the key within the first sensing region;

generating a key insertion speed profile based upon the outputs of at least some of the optical sensors;

determining a first characteristic of the bitting profile based at least in part upon the insertion speed profile;

generating a key profile based at least in part upon the key height signal, wherein the key profile includes information relating to the bitting code and information relating to the first characteristic;

comparing the key profile to authorization information, the authorization information including at least one authorized key profile including information relating to an authorized bitting profile and information relating to an authorized value of the first characteristic;

selecting an action based upon the comparing; and performing the action.

8. The method of claim 7, wherein the bitting profile includes a plurality of bittings and a plurality of teeth, each of the bittings has a bitting length, each of the teeth has a tooth length, and each of the teeth includes at least one ramp defining a ramp angle, and wherein the first characteristic comprises one of the bitting length, the tooth length, and the ramp angle.

9. The method of claim 7, wherein a second subset of the optical sensors extends in a length direction of the keyway, and a second sensing region is defined between the optical source and the second subset of the optical sensors;

wherein the method further comprises generating a key length signal based upon the output signals of the second subset of output sensors, wherein the key length signal corresponds to a length of the key within the second sensing region; and wherein generating the key insertion speed profile based upon the outputs of at least some of the optical sensors includes generating the key insertion speed profile based upon the key length signal.

10. The method of claim 7, wherein generating the key insertion speed profile based upon the outputs of at least some of the optical sensors includes generating the key insertion profile based upon the outputs of the first subset of the optical sensors and an authorized value of a second characteristic of the bitting profile.

11. A method of operating a lock device configured to receive a key including an edge cut defining a bitting profile, wherein the bitting profile defines a bitting code of the key and has a first characteristic and a second characteristic, the method comprising:

issuing an optical signal from an optical source into a sensing region of the keyway, wherein the bitting profile passes through the sensing region as the key is inserted into the keyway;

receiving the optical signal with a key height sensor including at least one optical sensor, wherein each of the at least one optical sensors is configured to generate an output signal in response to receiving the optical signal;

generating a key height signal based upon the output signals of the at least one optical sensors, wherein the key height signal varies in response to the bitting profile as the key is inserted into the keyway;

generating a key insertion speed profile based upon the key height signal and an authorized value of the first characteristic;

generating a key profile including information relating to the bitting code and information relating to the second characteristic, wherein generating the key profile includes:

generating the information relating to the bitting code based at least in part upon the key height signal; and generating the information relating to the second characteristic based at least in part upon the key height signal and the insertion speed profile;

comparing the key profile to authorization data including at least one authorized key profile, wherein each of the at least one authorized key profiles includes bitting code authorization data and second characteristic authorization data;

selecting an action based upon the comparing; and performing the action.

12. The method of claim 11, wherein the bitting profile includes a plurality of bittings and a plurality of teeth, each of the bittings has a bitting length, each of the teeth has a tooth length, and each of the teeth includes at least one ramp defining a ramp angle;

wherein the first characteristic includes at least one of the bitting length, the tooth length, and the ramp angle; and wherein the second characteristic includes at least one other of the bitting length, the tooth length, and the ramp angle.

13. The method of claim 11, wherein the authorization data further comprises additional data associated with each of the at least one authorized key profiles, and the selecting includes selecting the action based upon the key profile, a matching one of the authorized key profiles, and the additional data associated with the matching authorized key profile.

14. The method of claim 11, wherein the lock cylinder includes a photodiode comprising the optical source and the at least one optical sensor;

wherein issuing the optical signal includes transmitting the optical signal along a height direction of the keyway such that the key reflects the optical signal toward the photodiode as the bitting profile passes through the sensing region;

wherein the key height signal has a known relationship to a separation distance between the photodiode and the edge cut; and wherein generating the key profile includes generating the key profile based upon the known relationship between the key height signal and the separation distance.

15. The method of claim 11, wherein the at least one optical sensor includes a plurality of the optical sensors, the key height sensor comprises a key height sensor array including the plurality of optical sensors, and the key height sensor array extends in a height direction of the keyway; and wherein issuing the optical signal includes transmitting the optical signal along a width direction of the keyway such that the key casts a shadow on the key height sensor array as the bitting profile passes through the sensing region.

16. A lock device, comprising:

a body including a keyway sized and configured to receive a key including an edge cut defining a bitting profile of the key;

a sensor assembly including a key height sensor configured to generate a key height signal corresponding to a height of the key as the key is inserted into the keyway, wherein the key is configured to cause variations in the key height signal as the key is inserted into the keyway; and a controller in communication with the sensor assembly, wherein the controller is configured to generate a key insertion speed profile based upon information received from the sensor assembly, to generate a key profile based upon the key height signal and the key insertion speed profile, to compare the key profile to authorization data, to select an action based upon the comparing, and to perform the action.

17. The lock device of claim 16, further comprising an actuator in communication with the controller, wherein the action includes issuing a command to the actuator, and the actuator is configured to transition from a first state to a second state in response to the command.

18. The lock device of claim 17, further comprising a shell and a tailpiece, wherein the body comprises a plug rotatably mounted in the shell, wherein the plug is not operable to rotate the tailpiece with the actuator in the first state, and wherein the plug is operable to rotate the tailpiece with the actuator in the second state.

19. The lock device of claim 18, wherein the actuator is configured to rotationally couple the plug to the shell when in the first state, and to permit rotation of the plug with respect to the shell when in the second state.

20. The lock device of claim 18, further comprising a clutch mechanism including the actuator, the clutch having an uncoupled state including the first state of the actuator and a coupled state including the second state of the actuator, wherein the clutch mechanism is connected between the plug and the tailpiece, and wherein the clutch mechanism is configured to couple the plug and the tailpiece when in the coupled state, and to decouple the plug and the tailpiece when in the uncoupled state.

21. The lock device of claim 18, further comprising a tumbler set configured to retain the key within the keyway when the plug is in a rotated position with respect to the shell.

22. The lock device of claim 16, wherein the bitting profile of the key includes at least one ramp having a known ramp angle, and wherein the controller is configured to generate the key insertion speed profile based upon the key height signal and the known ramp angle.

23. The lock device of claim 16, wherein the key height sensor includes at least one first optical sensor, and wherein the key height sensor is configured to generate the key height signal based upon output of the at least one first sensor.

24. The lock device of claim 23, wherein the key height sensor includes a plurality of the first optical sensors and extends in a height direction of the keyway; wherein the sensor assembly comprises a plurality of optical sensors including the plurality of first optical sensors; wherein the sensor assembly further comprises an optical source configured to transmit an optical signal toward the plurality of optical sensors; wherein the key is configured to overlap a portion of the key height sensor as the key is inserted into the keyway, thereby preventing at least some of the first optical sensors from receiving the optical signal and causing variations in the key height signal.

25. The lock device of claim 24, wherein the plurality of optical sensors are positioned on a first side of the keyway, the optical source is positioned on a second side of the keyway, and the optical source is configured to transmit the optical signal across the keyway toward the plurality of optical sensors.

26. The lock device of claim 16, wherein the sensor assembly is further configured to sense an inserted length of the key within the keyway, and to generate a key length signal indicative of the inserted length; and wherein the controller is further configured to receive the key length signal and to generate the key profile based upon the key height signal and the key length signal.

* * * * *